US005456366A

United States Patent [19]

Wenkman

[11] Patent Number: 5,456,366

[45] Date of Patent: Oct. 10, 1995

[54] MULTILEVEL DESK PAPER TRAY

[76] Inventor: Gregory J. Wenkman, 6690 Shamrock Glen Cir., Middleton, Wis. 53562

[21] Appl. No.: 217,573

[22] Filed: Mar. 24, 1994

[51] Int. Cl.[6] ..... A47F 5/00

[52] U.S. Cl. ..... 211/11; 211/126

[58] Field of Search ..... 211/11, 50, 55, 211/126, 135, 188, 194

[56] References Cited

U.S. PATENT DOCUMENTS

| | | | |
|---|---|---|---|
| 4,469,231 | 9/1984 | Hehn | 211/11 |
| 4,657,148 | 4/1987 | Herg | 211/194 X |
| 4,785,939 | 11/1988 | Huerto et al. | 211/126 X |
| 4,863,042 | 9/1989 | Rohner | 211/11 |
| 4,974,733 | 12/1990 | Evans | 211/11 |
| 5,299,690 | 4/1994 | Mund et al. | 211/11 X |
| 5,363,974 | 11/1994 | Chan | 211/11 X |

OTHER PUBLICATIONS

Pp. 409,410,412–413, Office Essentials of Madison, 1994 Office Products Catalog.

Pp. 138 and 159, Badger Office Supplies, 1993 Office Products Catalog.

*Primary Examiner*—Robert W. Gibson, Jr.

*Attorney, Agent, or Firm*—Quarles & Brady

[57] ABSTRACT

A multilevel tray for letters or other contents is disclosed which includes two or more spaced apart bins having upwardly extending side rails and an upwardly bent backstop. Other attributes for ease of access and for installation may also be included. The multilevel tray of the present invention may be injection molded as a unitary form.

26 Claims, 6 Drawing Sheets

MULTILEVEL DESK PAPER TRAY

FIELD OF THE INVENTION

The field of the invention is desk trays for storing papers and in particular such trays having multiple levels.

BACKGROUND OF THE INVENTION

Trays for holding papers and the like are common fixtures in commercial and home offices. A useful desk paper tray includes a surface upon which the tray contents can rest as well as front, back and side walls for restraining the contents within the tray. In certain trays, one or more wall is absent, or reduced in size, to facilitate access to the tray and its contents. A wide variety of such trays are available. Typically, such trays are designed so that a plurality of single level trays may be stacked one atop the other or may be otherwise joined together for use.

The vast majority of such trays are formed by an injection molding process. Typically, in commercial molded plastic products, the cycle time of the mold which makes the product is one of the most significant factor in the cost of the molded product produced. Virtually all such desk trays have been molded as single bin trays using one or more cavities in an injection mold. Conventionally in such molds the base or planar paper carrying portion of the tray is planar with the junction between the main two halves of the mold. That geometry, combined with the required physical size of the tray has made the power, or tonnage, of the injection molding machine into which the mold is place a significant limitation on the number of cavities which can be simultaneously molded. Within these limitations, the available strategy to reduce cost has been to reduce the wall thickness of the molded tray, which reduces the part weight and thus the cost of the raw material. This process has now reached the point at which it is optimized for this type of mold.

It is believed that, owing to the physical constraints inherent in an injection molding process, no injection moldable multilevel letter tray has heretofore been manufactured. It has therefore been desired to produce a low-cost multilevel tray in a single cycle using a single two part mold in a single or multi-cavity mold assembly. Two part molds do not have "side actions" or "cams" which are secondary mold parts that approach the mold cavity from the side and which increase the cost of the mold. Until now, most single bin desk trays have been manufactured from molds using such side actions, which allows the tray to be made with a stackable feature so that individual trays may be stacked and locked one upon another. These side actions add considerably to the size, cost and complexity of the typical two cavity tray mold, and the larger the size of the mold, the larger the size of the molding machine required to use it. In addition, the tonnage of the injection molding machine required to successfully mold a high impact polystyrene part is usually calculated at a minimum of two tons of machine clamping force per square inch of area in the molded part that is planar to the mold face. Therefore, a desk tray that has an inside bin dimension of 10" by 12", where the base of the bin is planar to the mold face, requires a molding machine that can generate 240 tons of clamping force to successfully mold the part. A similar two cavity mold would require a minimum 480 ton injection molding machine. Thus, to mold eight or even four desk trays in a single operation becomes economically infeasible, using these conventional molding methods, due to the large size of the molding machine required.

Previously, several constraints have prevented the production of an integrally molded multilevel vertically stacked desk paper tray. The first constraint is the need to provide adequate draft in the mold. Draft is the slight taper provided in a design of the molded part that permits the two halves of an injection mold to be removed from a cured thermoplastic molded part, without disturbing the walls of the molded part. The draft taper is provided such that as the mold is drawn away from the molded part, the mold does not encounter any portion of the part narrower than, or at a narrower angle than, any portion already encountered. It is also desirable that no very large uninterrupted surfaces be formed by a mold, to decrease the chance of disruption of the part during withdrawal of the mold.

The second constraint is the need to minimize the cycle time per molded form. The cycle time is the length of time required for positioning the mold, injecting a uncured thermoplastic material, allowing the thermoplastic material to cure, and drawing the mold away from the molded form. It is desirable if the wall thickness of the part is uniform over the part, so that it cures uniformly. The rate at which the thermoplastic material cures is determined, in part, by the thickness of the material. It is desirable, therefore, to maintain a constant thickness of material in the part while also providing adequate structural support to form a stable, solid object.

A third constraint on producing an injection moldable multilevel desk tray has been the desire to provide an backstop at the rear of each bin, as a third wall for containing tray contents within the bin. Such a design has been believed to be incompatible with the desire to integrally mold a vertically arrayed set of bins.

A fourth constraint on an injection multilevel moldable paper tray is the difficulty inherent in using a two piece, i.e. front and rear type, mold to form the top and bottom faces of each vertically stacked bin.

Because of these dual constraints, the art has been unable to design an injection moldable multilevel desk tray having a commercially acceptable cycle time. It would therefore be desirable to manufacture multilevel trays that adequately restrain the contents of each tray and that may be injection molded as a unitary form with a commercially acceptable cycle time.

SUMMARY OF THE INVENTION

The constraints described are overcome by the multilevel paper tray of the present invention that may be injection molded as a unitary part with a uniform wall thickness and in an acceptable cycle time using a two part mold.

The multilevel paper tray of the present invention includes a plurality of spaced apart bins and spacers separating the spaced apart bins. Each bin includes a generally horizontal base portion and a pair of side arms.

In a second aspect, the multilevel paper tray may include a rear backstop formed during a second manufacturing step following injection molding. A molded planar tongue extending from the back edge of the base portion is upwardly bent by applying force to the planar tongue.

The tray is formed using a front and rear type mold in which opposing surfaces of each part are formed by different halves of the mold. This arrangement provides adequate draft to every surface and allows all of the portions of the multilevel tray to be formed with a uniform wall thickness, thereby keeping the cycle time short.

It is an object of the present invention to provide a multilevel tray that may be manufactured using a single injection molding step.

It is an advantage of the present invention that the output of trays thus manufactured is increased over single unit trays in that one molding step can produce an output equivalent to several single molding steps.

It is another advantage of the present invention that the bins and spacers are designed so that despite their relative thin width, they offer adequate strength to provide a stable multilevel tray.

It is yet another advantage of the present invention that the design facilitates a short dwell time, thereby further increasing the output of each mold.

It is a feature of the present invention that the planar tongue may be advantageously shaped into a backstop in a subsequent manufacturing procedure.

Further objects, features and advantages of the invention will be apparent from the following detailed description taken in conjunction with the accompanying drawings.

DESCRIPTION OF THE PREFERRED EMBODIMENT

The multilevel paper tray of the present invention is intended for use either on a horizontal or vertical surface, and is designed to allow efficient organization of files, papers and the like. The multilevel letter tray is advantageously manufactured as a single unitary form from an injection moldable thermoplastic material such as high impact polystyrene.

In this specification, references to directions such as front, rear, top and bottom are made with respect to the multilevel tray formed by the molding process. The front of the tray is the side which faces the user and through which the user would generally access the bins in the tray to add or to remove papers from a bin. References to the front and rear halves of the mold refer respectively to the pieces of the mold that move in and out of the front and rear of the finished molded product respectively.

In a multilevel letter tray produced in accordance with the invention, opposing surfaces (e.g., inside and outside, top and bottom) of each part or wall area are formed by opposing halves of a single front and rear (i.e. two-part) type injection mold. With this strategy, for some portions of the product, the drafts are complementary. For example, for the sides of the tray, the draft required by the rear half of the mold is an outward tapering from front to rear while the draft required by the front half of the mold is an inward tapering from rear to front. Thus, when these surfaces are on opposite sides of the same part or structure, the draft requirements are complementary to each other, and, therefore, a molded form provided with structures having a constant thickness across its entire breadth can be manufactured. In this application, "complementary" draft refers to the draft on opposing faces of a molded part whereby the front half of the mold forms one of the faces and the rear half of the mold forms the opposing face. Because of the complementarity of the drafts, both halves of the mold can readily withdraw from the molded form without damaging the form.

Had opposite faces of a particular structure been formed by a single half of the mold, the sides of that particular structure would have to converge so that the mold could be pulled from the two surfaces. In this less desirable arrangement, the thickness of the wall of the part produced would not be uniform, but would rather be diverging. The amount of thermoplastic material required to fill the thicker portions would take an unacceptably long time to cure and would reduce or eliminate the economic viability of the desired multilevel tray by increasing the cycle time.

Figure 1:
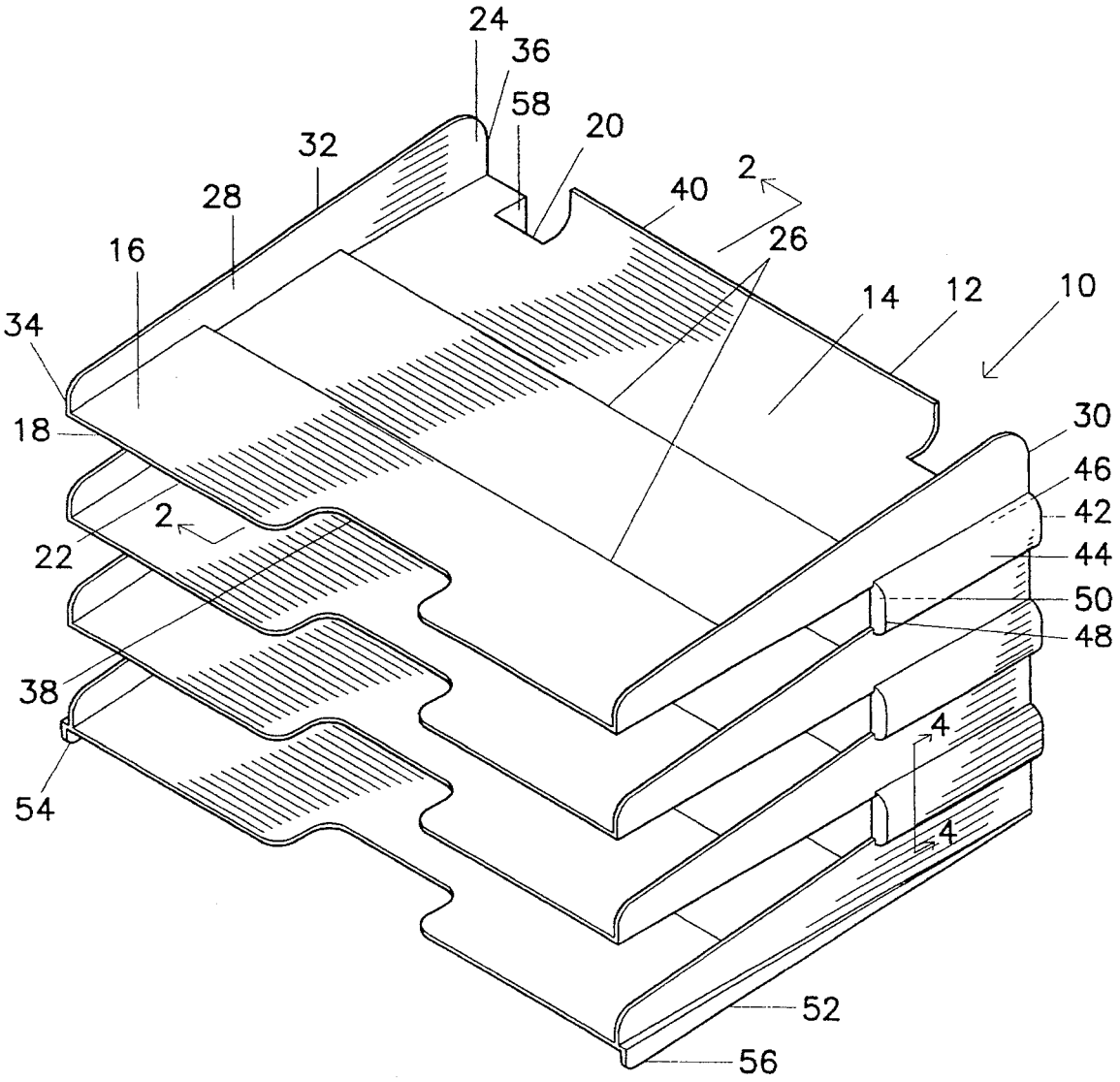
FIG. 1 a perspective view of a preferred embodiment.
Figure 2:
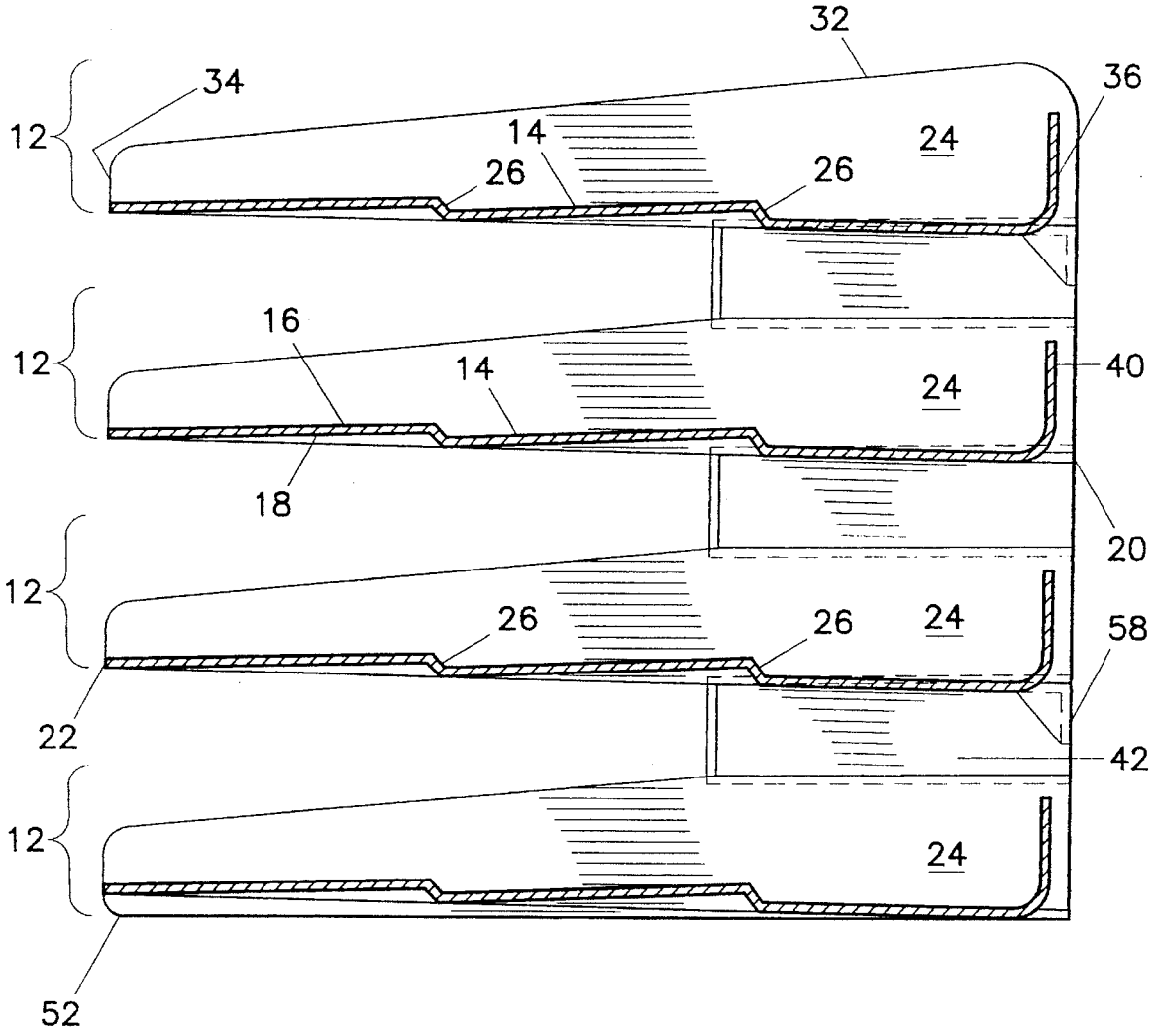
FIG. 2 is a sectional view taken along line 2—2 of FIG. 1
Figure 3:
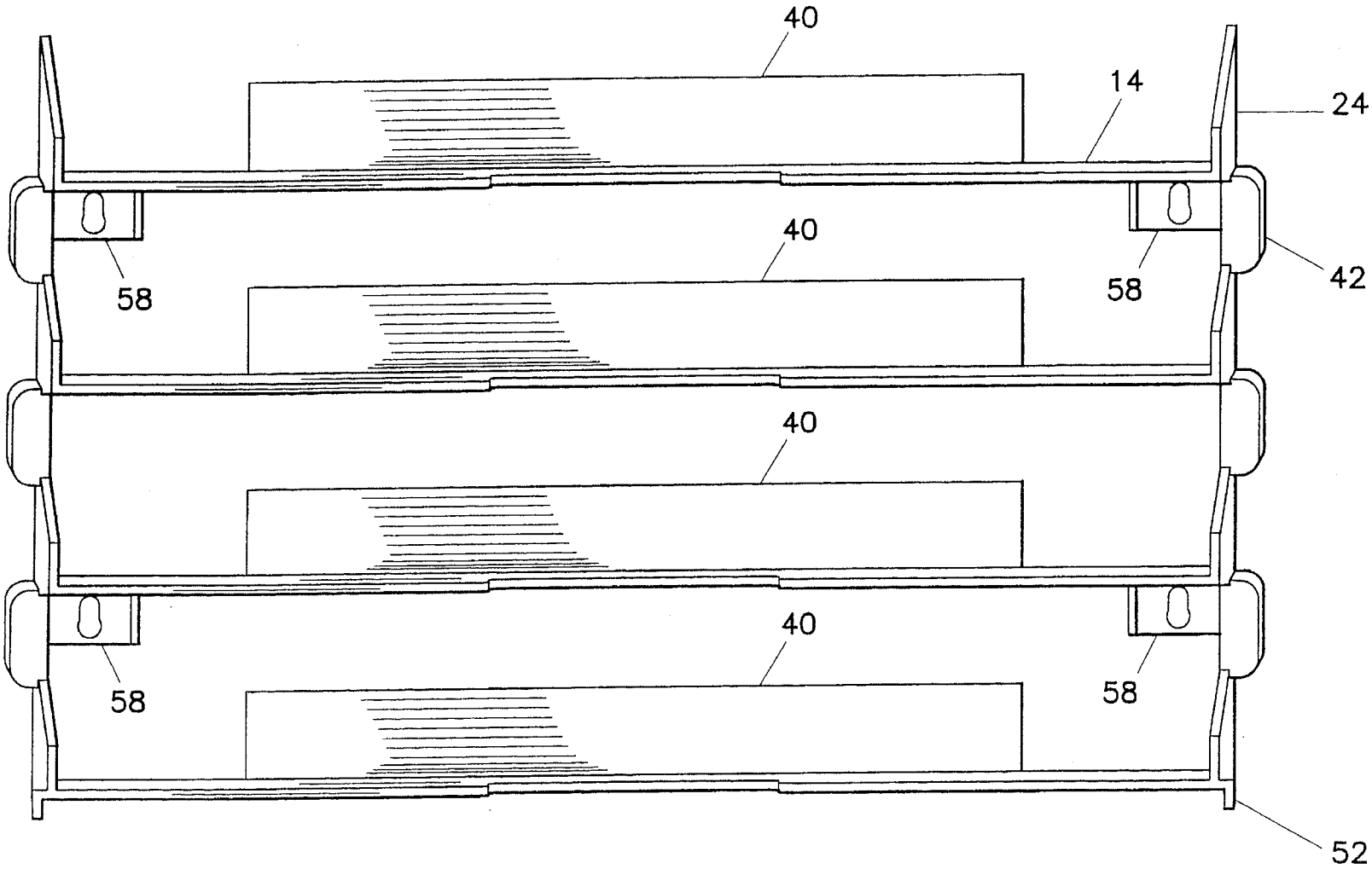
FIG. 3 is a front artline view of the tray of FIG. 1.
Figure 4:
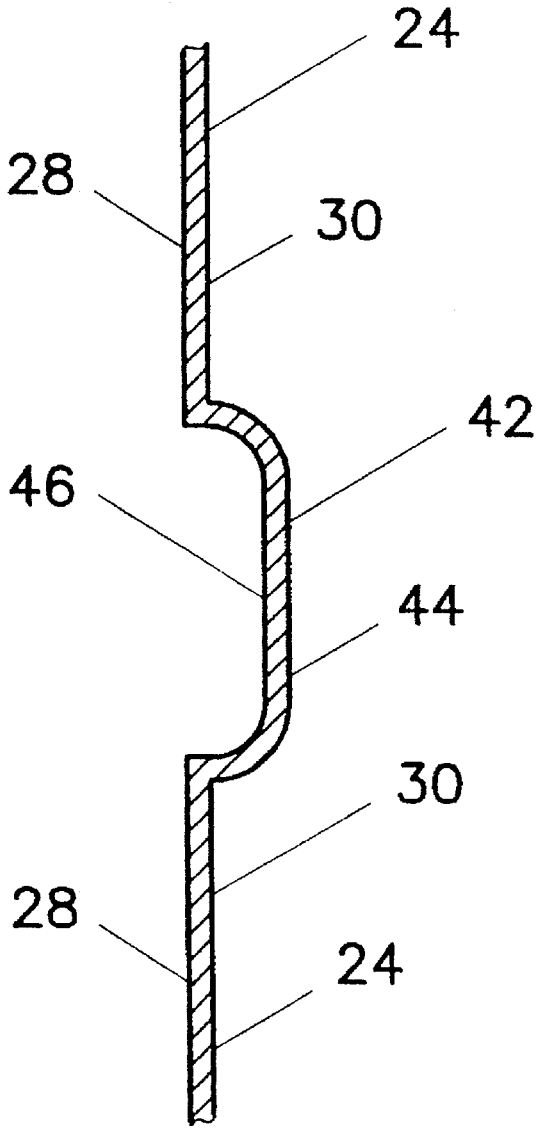
FIG. 4 is a partial sectional view taken along line 4—4 of FIG.

With reference to the drawings, a preferred embodiment of an integrally molded multilevel desk paper tray constructed in accordance with the present invention is shown generally at 10 in FIG. 1 and in cross-section in FIG. 2. The multilevel tray 10 includes generally a plurality of spaced-apart bins 12. Each bin includes a generally horizontal tray base 14 which has a top face 16 and a bottom face 18, a back edge 20 and a front edge 22. The sides of each bin 12 are formed by two opposed side arms 24 extending upward from the base portion 14.

Each of the tray bases 14 are provided with one or more pairs of strengthening ridges 26 which extend laterally, or from side to side, across the tray base 14. These ridges 26 divide each tray base 14 into several (here three) planar sections 27. When the tray 10 is resting on a flat surface, each of the three planar sections 27 is oriented such that each section 27 is very slightly canted upward toward the rear of the tray or, in other words, the rear edge of each section 27 is slightly higher than the front edge of that section 27. However, since each ridge 26 is sharply canted downward toward the rear of the tray, the overall slope or cant of each tray base 14 is downward toward the rear of the tray 10. Throughout its area, each of the tray bases 14 are generally uniform in thickness. Thus the top face 16 and the bottom face 18 of each tray base are generally parallel and spaced apart by a uniform distance. While the ridges 26 are shown to be linear in this embodiment, they may also be angled, curved or otherwise pleasingly shaped as long as the ridges cant downward toward the back of the tray. Note that while it is conventional to have some indentation or ridge or valley in a tray bottom to increase its strength, the ridges 26 are unique in that they all cant downward toward the rear of the tray. This factor is significant in the moldability of the tray, as will be discussed in more detail below.

The upwardly extending opposed planar side arms 24 are molded to the sides of the base portion 14 of each bin in a generally perpendicular arrangement and are of a constant uniform thickness. The vertical side arms have an inner face 28 and an outer face 30, as well as free edges at the top 32, front 34, and rear 36. A free edge is an edge not otherwise molded to another part of the multilevel tray. The three upper sets of side arms 24 are terminated at their lower margin by bottom edges 37. The side arms 24 themselves are angled inward slightly from rear to front of the bin, and outward from front to rear, on both their inner and outer faces 28 and 30, to facilitate removal of the front half of the mold from the outer face 30 and removal of the rear half of the mold from the inner face 28 during molding. The angling of the side arms 24 is very slight, so that it is not readily obvious to the casual observer, and the result is that the base portion of each bin is very slightly wider at its back edge 20 as compared to its front edge 22. The side arms 24 are also generally shorter toward the front of the multilevel tray and taller toward the rear. The free front and rear edges 34 and 36 of the side arm 24 join the free top edge 32 at rounded corners. The bottom edges 37 are formed at a slant, canted downwardly toward the back of the tray. As can be seen in the cross-sectional view of FIG. 2, the base portions 14 are attached to the upper three sets of side arms 24 above the bottom edges 37, with each bottom edge intersecting the bottom face 18 of each base portion at the front and at the lower edge of each ridge 26.

The front edge 22 of each base portion 14 can include a molded or cut-out recess 38 for improving access to a tray's contents. In the preferred embodiment, the recess 38 is trapezoid with rounded corners.

A multilevel letter tray constructed in accordance with the present invention may also include a backstop on one or more of the bins 12 in the multilevel tray 10. The backstop simply assures that no papers or other contents can fall out of the rear of the bins 12. If a backstop is desired on some or all of the bins 12, a planar tongue 40, co-planar with the rearmost section of the base portion 14 and rearwardly extending from the back edge 20, is provided during molding. If it is determined that no back stop is necessary, such as would be the case in a tray made for wall-mounting only, the tongue 40 need not be included in the multilevel tray design. The tongue 40 and rear section of the base portion 14 are molded in a coplanar relationship so that the tongue 40 does not interfere with withdrawal of the front and rear halves of the mold after the base portion 14 has cured. The backstop is formed from the planar tongue 40 in a second process step that is performed after injection molding, but before the injected plastic material has completely solidified. In the second step, the planar tongue 40 is bent upward, using a jig or other fixture, from a generally horizontal position to a generally vertical position, roughly perpendicular to the base portion 14.

In the embodiment of FIG. 1, between each pair of spaced apart bins 12, are a pair of spacers 42. The spacers 42 connect the adjacent side arms 24 of adjacent bins 12. Each spacer 42 is generally rectangular in shape when viewed from the side of the multilevel tray 10. However, the profile of each face of the spacer 42, like that of every surface of the apparatus 10, is influenced by the need for adequate draft for the mold halves and the desire to maintain uniform wall thickness. An outer side face 44 of each spacer 42 is visible at the side of the multilevel tray 10. Each spacer 42 also has an inner side face 46 visible only from the bin side of the spacer 42. An outer front face 48 of each spacer is visible from the front of the multilevel tray 10. Each spacer 32 also has an inner front face 50 visible only from the bin side of the spacer 32.

The outer side and front faces 44 and 48 are formed by the front half of the mold. The inner side and front faces 46 and 50 are formed by the rear half of the mold. The inner and outer side faces 44 and 46 generally taper inward from rear to front of the multilevel tray 10. The inner and outer front faces 48 and 50 simply abut flat surfaces on the rear and front halves of the mold, respectively. As was the case with the base portions 14 and side arms 24, this complementary arrangement permits the spacers to be formed with constant thickness, and avoids the problem that would have occurred had the inner and outer side faces 46 and 44 both been formed by just one half of the mold.

It is preferred in this embodiment that the spacers 2 are not flush with the side arms 24, but protrude outwardly from the sides of the multilevel tray 10. In the outwardly protruding embodiment the inner side face 46 of each spacer forms a trough-like depression.

The tray 10 preferably also includes additional features for improving access to the tray contents or for positioning the tray on a desk or wall. Downward extending support rails 52 provide stabilizing and leveling support to the multilevel tray 10 and are integrally molded to the two side arms 24 of the lowest bin 12 of the vertical stack. The support rails 52 taper in size from the front to the back of the tray 10, being thus taller or thicker in the front of the tray 10 and shorter or thinner in the back of the tray 10. Thus, looking at the side of the tray, the top edge of each support rail 52 is canted downwardly toward the back of the tray 10. At the same time, the two support rails 52 are not perfectly parallel to each other, but taper in a manner complementary to the top of the side arms 24. Thus the front edges of the support rails 52 are slightly wider apart than the back edges of the support rails 52. Since at the back edge of the tray, the sides faces of the support rails 52 and the side panel 24 of the lowermost bin meet at the rear lower corners of the tray 10, the outside face of each of the support rails diverges outward from the adjacent side arm 24 toward the front of the tray 10.

As an alternative to the support rails 52, it would be possible to form ridges or rails extending downward from the bottom face of the lowermost base 14. Such ridges would then be formed by the front half of the mold and would again be taller at the front of the tray than at the back, but they could be located inward from the sides of the tray. To assist in removal from the mold, the sides of these support rails would be very slightly tapered. Such supports may only extend a portion of the front-to-rear dimension of the tray.

Another support alternative is provided for the tray 10. Two pairs of wall mount tabs 58 are provided in the tray, one pair dependent from the bottom surface of the top most and the third highest bin bases 24. Each mount tab 58 is a rectangular tab with a keyhole shaped aperture formed in for mounting on a screwhead or other mounting projection secured to a vertical surface. The mount tabs 58 are co-planar with the back face of the tray 10 so that the tray can be mounted on a vertical surface from those tabs.

Figure 5:
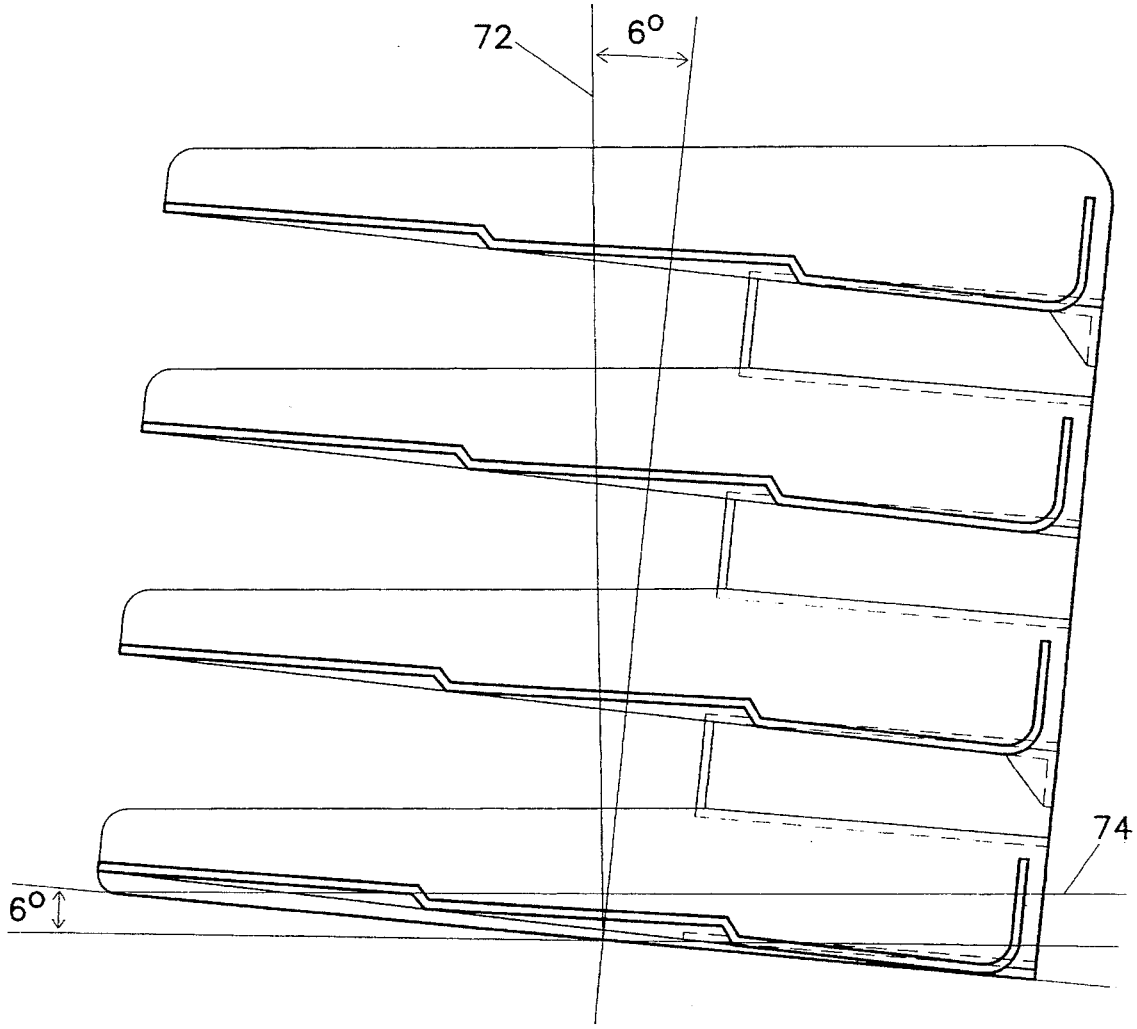
FIG. 5 is a schematic side view illustrating the molding of the tray of FIG. 1.

The various tapers and canted surfaces of the tray 10 are provided so that the tray can be readily molded in a two-piece mold without side actions. In such a two piece mold, typically one half of the mold is fixed while the other half linearly reciprocates toward and away from the fixed half to close and open the mold. Shown in FIG. 5 is a cross-sectional view of the tray of FIG. 1 tilted at an angle to illustrate how the mold for this part can work. In FIG. 5, a vertical line 72 is drawn. This line 72 represents the general plane at which the two mold halves meet. While, as will be appreciated from the following discussion, the molding surfaces of the two mold halves are intricate, the general junction between the mold halves is parallel to the line 72 in FIG. 5 and the movable mold half, which would be to the left of FIG. 5, moves linearly perpendicular to the line 72 in FIG. 5. Note that the tray 10 is tilted slightly from the perpendicular with respect to the mold half line 72. The horizontal plane of the tray 10, as indicated by the bottom horizontal edge of the tray, is tilted 6° (exaggerated in FIG. 5) from perpendicular to the line 72, with the front of the tray 10 raised slightly above the back. This tilt, and the configuration of the tray parts, ensures enough draft between the mold and the part to successfully mold the tray 10 with uniform wall thickness. The tilt of the tray 10 in the mold can be anywhere from 1°, to provide some tilt, to 20°, with the upper limit being determined by the need for the mold parts forming the faces of the base portions 14 to reach to the opposite side of the tray 10.

In considering why the parts of the tray 10 are formed with their various tapers and cants, an understanding of the mold parts is helpful. In molding the tray 10 of FIGS. 1–5, the back or fixed half of the mold forms the top face 16 of each base portion 14, and the inner face 30 of each side arm 24. The front or movable half of the mold forms the bottom face 18 of each base portion 14 and the outside face 28 of each side arm 24. The front or movable mold half also forms the inside surfaces of the support rails 52 and the front face 50. The tongues 40 are, as stated above, molded as planar extensions of the base portions 14, and are then bent upward in a subsequent manufacturing step.

The various canted surfaces of the tray 10 and the tilted orientation of part in the mold, as illustrated n FIG. 5, allows the tray to be molded with just a two piece mold without side actions or cams. Notice, in FIG. 5, the lines designated 74 which extend horizontally to the right from the bent points in the lowermost tray base 14. These lines illustrate that the molded tray can be pulled from the mold without the mold impacting any protuberance of the molded part. Thus, for example, even though each of the sections 27 slants slightly upward when the tray 10 is horizontal, the tilt of the tray 10 in the mold, as shown in FIG. 5, is greater than the angle of cant of the sections so that the draft of the mold is proper.

It is for reasons of the withdrawal of the mold halves that the side arms 24 are angled to be slightly narrower in the front of the tray 10. This allows the rear of the mold to be pulled from the interior of the two side arms or, in actuality, the molded tray 10 to be pulled from the mold. The support rails 42 are angled the opposite direction to allow the front or movable mold half, forming the bottom face of the bottom base portion, to pull out of the mold, to the left as viewed in FIG. 5, without disrupting the part.

Figure 6:
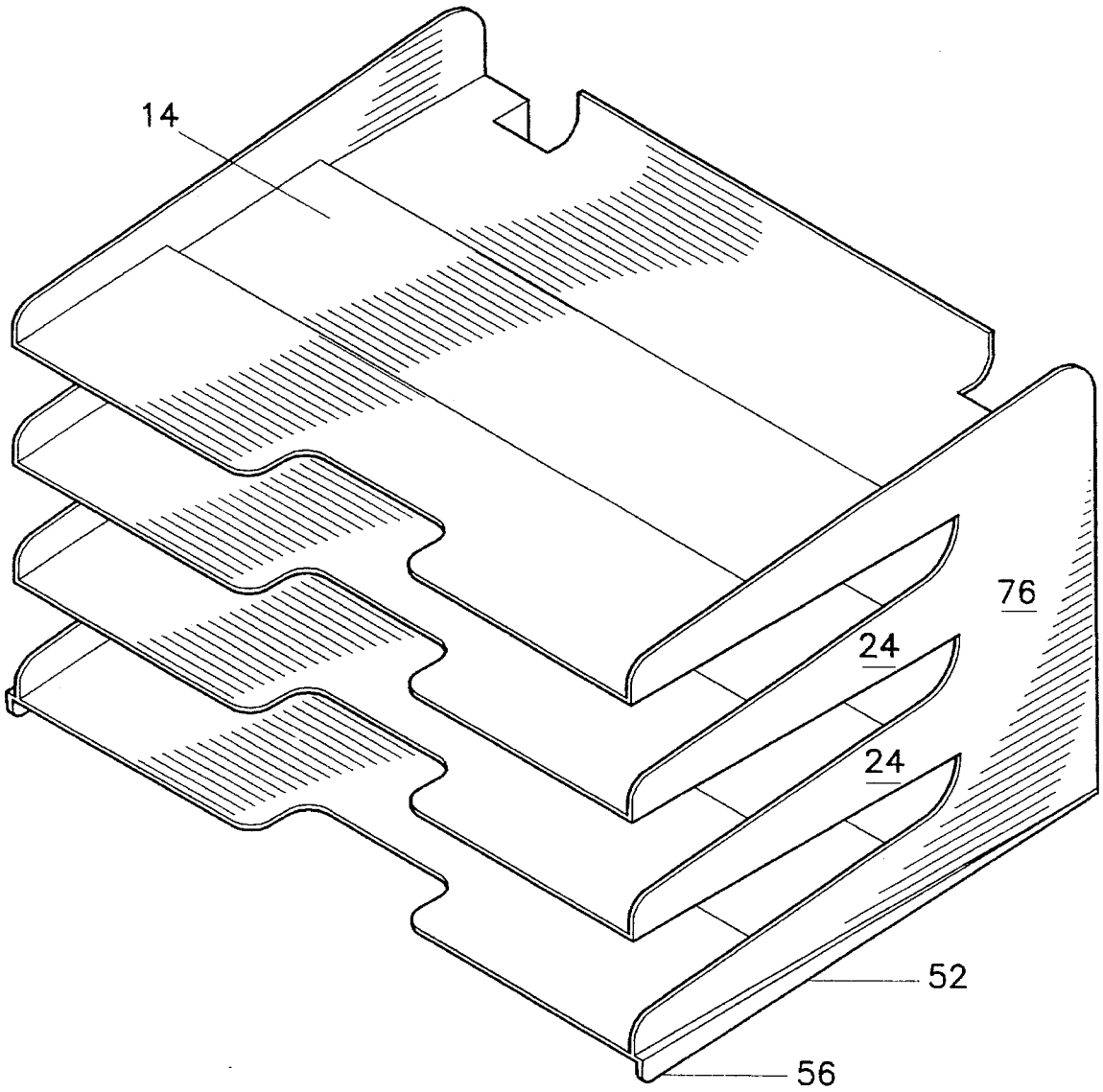
FIG. 6 is a perspective view of an alternative embodiment of the present invention.

Shown in FIG. 6 is an alternative embodiment of the tray 10. In this embodiment, otherwise similar to the embodiment of FIG. 1, the spacers 42 have been omitted, being replaced by panels designated 76 in FIG. 6. This version requires a slightly more refined interplay between the two mold halves. The outer face of the panel 76 is molded by the front or movable mold half while the inside face of the panel 76 is molded by the rear or fixed mold half. Since the underside of each base 14 is molded by the front mold half, to mold this version, the front and rear mold halves have to fit precisely together at the juncture of the lower face of the base 14 and the top edge of the inside face of each panel 76. This is practical, although slightly more exacting of mold design than the mold for the embodiment of FIG. 1.

It is to be understood that the present invention is not limited to the particular arrangement and embodiments of parts disclosed and illustrated herein, nor to the material specified, but embraces all such modified forms thereof as come within the scope of the following claims.

I claim:

1. An integrally molded multilevel desk paper tray having a front and a back, the tray comprising:

at least two vertically stacked paper bins, each bin formed from a base portion having a top face, a bottom face, and front, back and side edges, and a pair of side arms formed upstanding at each side edge of the base portion, each base portion including a pair of strengthening ridges formed extending laterally therein, the ridges canted only downwardly toward the back of the tray, the side arms angled relative to each other such that they are closer at the front of the tray than at the back, so that the top face of each base portion and the inside of each side arm can be molded by a mold which can be withdrawn from the back of the tray.

2. A tray as claimed in claim 1 wherein there are four of the bins in the tray.

3. A tray as claimed in claim 1 wherein each of the strengthening ridges is parallel to the back of the tray.

4. A tray as claimed in claim 1 further comprising a pair of support rails located extending downward from the side arms on the lowermost bin to support the tray on a horizontal surface.

5. An integrally molded multilevel desk paper tray having a front and a back, the tray comprising at least two vertically stacked paper bins, each bin formed from a base portion having a top face, a bottom face, and front, back and side edges, and a pair of side arms formed upstanding at each side edge of the base portion, a tongue extending from the back edge of each of the base portions to define the back of each bin so as to restrain papers in the bin, the tongue formed as an upwardly curved extension from the back edge of each base portion.

6. A tray as claimed in claim 5 wherein the tongue if molded as a linear rearward extension of the base portion of each bin which is then bent upward in a subsequent manufacturing step.

7. A tray as claimed in claim 5 wherein the side arms are canted relative to each other such that they are closer together at the front of the tray than at the back.

8. A tray as claimed in claim 5 wherein there are ridges extending laterally in each of the base portions, the ridges being slanted only downward toward the back of the tray.

9. An integrally molded multilevel desk paper tray having a front and a back, the tray comprising:

at least two vertically stacked paper bins, each bin formed from a base portion having a top face, a bottom face, and front, back and side edges, and a pair of side arms formed upstanding at each side edge of the base portion, each base portion including a pair of strengthening ridges formed extending laterally therein, the ridges canted only downwardly toward the back of the tray, the side arms angled relative to each other such that they are closer at the front of the tray than at the back, so that the top face of each base portion and the inside of each side arm can be molded by a mold which can be withdrawn from the back of the tray, and the side arms being joined by spacers which are bulbous extensions extending outwardly from the sides of the tray.

10. A tray as claimed in claim 9 wherein there are four of the bins in the tray.

11. A tray as claimed in claim 9 wherein each of the strengthening ridges is parallel to the back of the tray.

12. A tray as claimed in claim 9 further comprising a pair of support rails located depending from the side arms on the lowermost bin to support the tray on a horizontal surface.

13. A tray as claimed in claim 9 further comprising at least one pair of wall mounting tabs depending from the lower back edge of a base portion so that the tray can be mounted on a vertical surface.

14. An integrally molded multilevel desk paper tray having a front and a back, the tray comprising:

at least two vertically stacked paper bins, each bin formed from a base portion having a top face, a bottom face, and front, back and side edges, and a pair of side arms formed upstanding at each side edge of the base portion, the side arms angled relative to each other such that they are closer at the front of the tray than at the back, so that the top face of each base portion and the inside of each side arm can be molded by a mold which can be withdrawn from the back of the tray, a pair of support rails located under the lowermost side arms to support the tray when it is placed on a horizontal surface, and at least one pair of wall mount tabs formed on the back of the tray depending from the bottom of a base portion, each of the wall mount tabs having an aperture formed in it so that the tray can be suspended from a vertical surface as well.

15. A tray as claimed in claim 14 wherein there are two pairs of the wall mount tabs.

16. A tray as claimed in claim 14 wherein the support rails taper such that they are wider and taller at the front of the tray and closer and shorted at the back of the tray.

17. A tray as claimed in claim 14 wherein there are four of the bins in the tray.

18. A tray as claimed in claim 14 wherein there are ridges extending laterally in each of the base portions, the ridges being slanted only downward toward the back of the tray.

19. A tray as claimed in claim 18 wherein each of the strengthening ridges is parallel to the back of the tray.

20. A method of molding a bin desk paper tray comprising the steps of injection molding a multiple bin tray in a two part mold with front and rear mold halves without side actions, each bin in the tray having a base portion and a pair of side arms, the side arms canted to be wider at the front of the tray and narrower at the back, the top face of each base portion and the inside of each side arm being molded by the rear mold half while the bottom face of each base portion and the outside of the side arms are formed by the front mold half, an elongated tongue molded extending from the rear of each of the base portions beyond the back of the tray, and bending the tongue upward to form a backstop to retain papers placed in each bin.

21. A method as claimed in claim 20 wherein the tray is canted relative to the axis of motion of the mold halves during molding.

22. A method as claimed in claim 21 wherein the angle of cant is between 1° and 20°.

23. A method as claimed in claim 22 wherein the angle of cant is 6°.

24. A method as claimed in claim 20 wherein there is also a pair of support rails formed under and depending from the lowermost side arms of the tray, the front half of the mold forming the inside of the side rails while the back half of the mold forms the outside of the side support rails.

25. A method as claimed in claim 20 wherein the outside vertical side wall surface of the tray is flat.

26. A method as claimed in claim 20 wherein the tray further includes a pair of support rails under the lowermost bin to support the tray on a horizontal surface.

* * * * *